United States Patent [19]

Pigman et al.

[11] 4,112,274

[45] Sep. 5, 1978

[54] ELECTRICAL CONTROL

[75] Inventors: Chester Joseph Pigman, Uniontown; James Arthur Pewton, Sr., North Canton, both of Ohio

[73] Assignee: General Power Corp., Akron, Ohio

[21] Appl. No.: 655,251

[22] Filed: Feb. 4, 1976

[51] Int. Cl.[2] ..... H01H 3/00; H01F 29/04

[52] U.S. Cl. ..... 200/146 R; 200/144 AP; 200/8 A; 200/11 TC; 200/179

[58] Field of Search ..... 200/144 R, 144 AP, 146 R, 200/146 A, 8 A, 179

[56] References Cited

U.S. PATENT DOCUMENTS

| | | | |
|---|---|---|---|
| 447,230 | 2/1891 | Chamberlain | 200/146 R |
| 1,102,562 | 7/1914 | Anderson | 200/144 AP |
| 1,861,129 | 5/1932 | Milliken | 200/144 AP |
| 2,753,432 | 7/1956 | Long et al. | 200/144 R |
| 3,011,041 | 11/1961 | Bakels | 200/8 A |
| 3,174,097 | 3/1965 | Bleibtreu | 200/144 AP |
| 3,247,435 | 4/1966 | Baumhart et al. | 200/8 A |
| 3,343,115 | 9/1967 | Greenwood | 200/144 AP |
| 3,912,974 | 10/1975 | Hill | 200/144 AP |

FOREIGN PATENT DOCUMENTS

| | | | |
|---|---|---|---|
| 1,187,448 | 4/1970 | United Kingdom | 200/144 B |
| 1,291,043 | 9/1972 | United Kingdom | 200/144 B |

*Primary Examiner*—Robert S. Macon

*Attorney, Agent, or Firm*—Hamilton, Renner & Kenner

[57] ABSTRACT

An electrical control for providing a graduated change in the magnitude of electrical energy transferred from a source of electrical energy to a device driven thereby including a mount, a plurality of load contacts disposed in fixed relation on the mount, a movable power contact engaging certain of the plurality of load contacts, a movable transition contact associated with the movable power contact first engaging each of the load contacts engaged by the movable power contact to provide an alternate full load current path through each of the load contacts engaged by the movable power contact prior to engagement by the movable power contact, thus providing a transition between the load contacts engaged by the movable power contacts which are connected to differing magnitudes of impedance substantially without arcing; and a third movable contact may be provided for selectively engaging other of the plurality of load contacts for effecting a switching function.

40 Claims, 7 Drawing Figures

ELECTRICAL CONTROL

BACKGROUND OF THE INVENTION

In general, the invention relates to an electrical unit for controlling the transfer of electrical energy from a source of electrical energy to a device driven thereby. More particularly, the invention relates to electrical control apparatus capable of initiating and controlling the magnitude of electrical energy transferred from a source of electrical energy to a device driven by the source. More specifically the invention relates to electrical control apparatus for interconnecting a source of electrical energy such as one or more batteries and a driven device such as an electric motor which converts electrical energy to mechanical energy, the apparatus having the capability of controlling the direction and speed of rotation of such a driven device with arcing eliminated or substantially reduced.

The conversion of electrical energy to mechanical energy by electric motors in applications such as industrial and recreational vehicles has been known for many years. More recently, attempts are being made to develop electric motor driven automobiles due to environmental and other considerations. In general, the electrical control units for regulating the magnitude of current flow from a battery to a drive motor in such applications has been noteworthy for lack of technical sophistication. Characteristically such apparatus has employed a plurality of fixed contacts associated with differing magnitudes of resistance and a single movable contact which sequentially engages the fixed contacts to provide current flow of a graduated magnitude to the drive motor. The inevitable arcing and heat attendant the engagement and disengagement of the fixed contacts by the movable contacts in such arrangements is compensated for to an extent by providing massive contacts which have some capability of withstanding repeated arcing and attendant burning. However, whatever the size and material composition of such contacts, it is universally known that such units experience rapid deterioration in performance uniformity due to burning and pitting of the contacts if not total operational failure. Frequent replacement of the contacts or the control units in their entirety has become accepted practice in the use of devices of this nature. These problems are further intensified and become increasingly critical in larger driven units operating in higher power ranges.

The reduction or control of such deleterious arcing in these or other similar applications have been the subject of considerations on many different fronts. It has been theoretically recognized that electrical arcing occurs when electrical conductors of differing magnitudes of potential come into sufficiently close physical proximity for the geometric and interfacing characteristics extent that the interface medium becomes conductive or when physically connected conductors in which a current is flowing are drawn apart thereby ionizing the interface medium into a conductive state. In the operation of the commercial electrical control units described above both of these conditions tending to produce arcing are encountered, normally on a repetitive basis.

In various applications, the prior art has recognized several techniques which may be employed to control arcing to some extent in the aforementioned conditions. One approach contemplates the preconditioning of electrical conductors to substantially the same electrical potential prior to their coming into sufficiently close physical proximity to produce arcing. Another approach contemplates the reduction of an existing current flow between connected conductors prior to effecting physical separation. Closely related to this latter approach is a technique involving the establishment of an alternate current path of a much higher resistance than the normal current path through the conductors such that a "bleed" path is provided for the current during the separation of the electrical conductors or a "trickle" current is established between the conductors prior to their engagement. Further refinements of this technique involve methods of switching in the alternate current path just prior to the separation of the electrical conductors and the switching out of the alternate current path immediately following separation of the electrical conductors to thereby conserve the power losses attendant to the establishment of such alternate current path. Due to the requirement that an alternate high impedance, low current path be maintained for only a brief time duration and the requirement for high power handling capabilities, these various prior art devices have not provided a viable solution to the problems presented in the electrical control apparatus applications hereinabove discussed.

SUMMARY OF THE INVENTION

Accordingly, it is an object of the present invention to provide electrical control apparatus for controlling the transfer of electrical energy from a source of electrical energy to a device driven thereby with graduated changes in the magnitude of electrical energy transferred substantially without arcing engagement of the elements thereof. Another object of the invention is to provide such electrical control apparatus wherein a plurality of fixed contacts are sequentially engaged by a movable load contact and wherein a transition contact and associated circuitry established an alternate full load current path through each fixed contact prior to engagement of the same by the movable load contact. A further object of the invention is to provide such electrical control apparatus wherein the transition contact and circuitry establishes a relatively low impedance full load current path which is maintainable over a time period such as to permit the transition and load contacts to operatively repose in any position relative to the fixed contacts. Still another object of the invention is to provide such electrical control apparatus wherein the transition contact is moved into substantial physical contact with each fixed contact prior to the establishment of current flow therethrough and the current flow is severed prior to the time the transition contact moves out of substantial physical contact with the fixed contact to eliminate or substantially reduce any arcing or tendency thereto between the various contacts.

A further object of the invention is to provide such electrical control apparatus wherein any minimal arcing is localized within the contact portion of a relay which may be conveniently and easily periodically maintained or replaced if necessary. Still another object of the invention is to provide electrical control apparatus which in addition to providing graduated changes in the magnitude of electrical energy transfer also provides for selectively controlling the direction of rotation of a device driven by an electrical energy source. Yet a further object of the invention is to provide such an electrical control apparatus wherein the direction and magnitude of electrical energy transfer are interrelated such that energy may be transferred only at selected times and such that alterations in the direction of energy transmission are permissible only when no energy is being transferred from the electrical energy source to a driven device. Still another object of the invention is to provide such an electrical control apparatus which can be made in a relatively compact and non-complex configuration such that the components thereof have the expectancy of an extended service life with high reliability and ease of service in the event of a component failure.

These and other objects together with the advantages thereof over existing and prior art forms which will become apparent from the following description are accomplished by the means hereinafter explained.

In general, electrical control apparatus for providing a graduated change in the magnitude of electrical energy transferred from a source of electrical energy to a device driven thereby includes a mounting device, a plurality of discrete load contacts disposed in fixed relation on the mounting device and connected with differing magnitudes of impedance, a power contact movable relative to the load contacts for sequential engagement therewith, a transition contact connected to each of the discrete load contacts prior to engagement by the power contact, and transition circuitry providing a full load alternate current path through each of the discrete load contacts prior to engagement of same by the power contacts to thus provide the requisite graduated change in the magnitude of electrical energy transfer substantially without arcing between the contacts.

DESCRIPTION OF A PREFERRED EMBODIMENT

Figure 2:
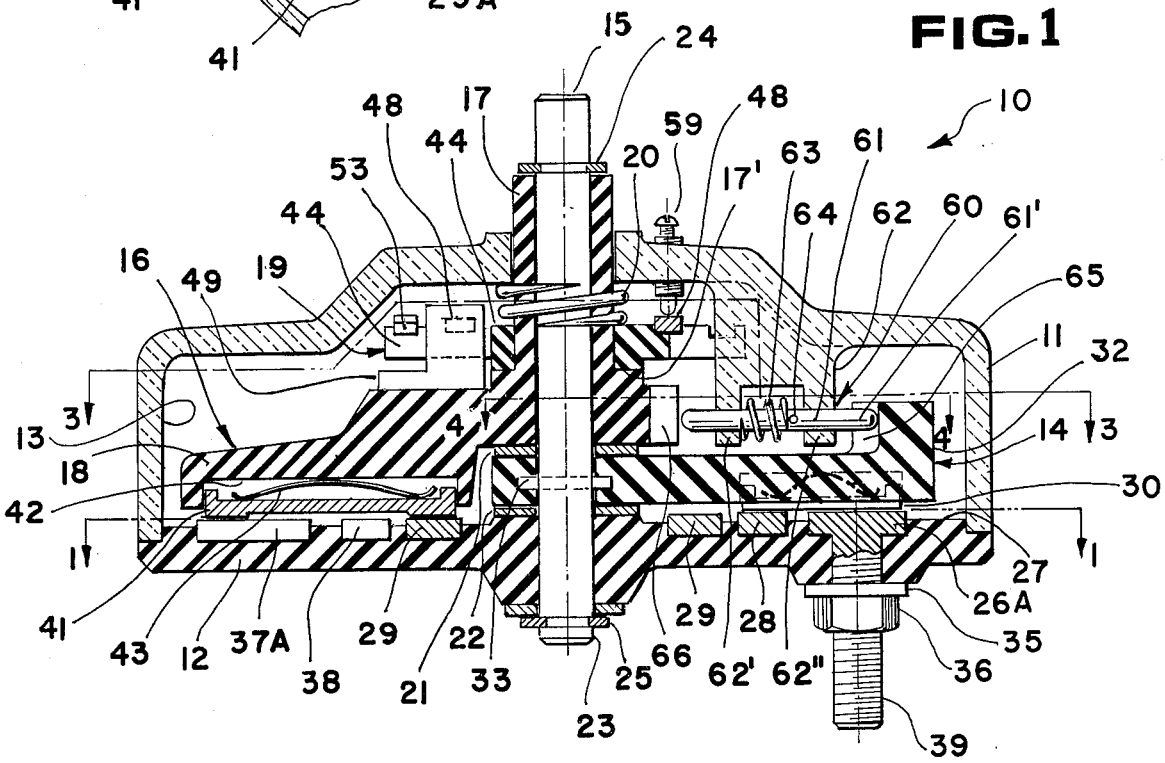
FIG. 2 is an elevational view through the electrical control apparatus according to the present invention taken substantially along line 2—2 of FIG. 1.

Referring now to the drawings generally, in which like reference characters designate like or corresponding parts through the various views, and particularly to FIG. 2 thereof, an electrical control apparatus embodying the concepts of the present invention is illustrated generally by the numeral 10. In this depicted embodiment the electrical control apparatus 10 includes a somewhat cup-shaped generally cylindrical housing 11 closed at one extremity by a bottom plate 12 which may be affixed to housing 11 by any suitable means including adhesion or by removable fasteners (not shown) so as to facilitate entry into an interior annular chamber formed by inner wall 13 of housing 11. These structural units may be formed of any of a number of electrical insulating materials such as any one of a number of plastics which would occur to persons skilled in the art. Although for convenience the electrical control apparatus 10 is depicted and shall hereinafter be referred to in the description with the axis that is perpendicular to and in the center of bottom plate 12 as the "vertical axis", it should be appreciated that the apparatus may be mounted and will operate equally well in any attitudinal position.

The operational elements of electrical control apparatus 10 include a direction control assembly, generally indicated by the numeral 14, having a direction control shaft 15 which extends along the vertical axis through cylinder housing 11, its interior annular chamber, and bottom plate 12. The direction control assembly 14 is rotatably carried by direction control shaft 15 and a portion thereof is interposed between spacers 21 and 22 so as to provide appropriate spacing as will be hereinafter further described. A velocity control assembly, generally indicated by numeral 16, includes a velocity control shaft 17, which is coaxially associated with direction control shaft 15 and carries elements which are independently rotatable about the vertical axis of electrical control apparatus 10. An electrical sequencing assembly, generally indicated by the numeral 19, is coaxially disposed around velocity control shaft 17 and seats against a collar 17' formed thereon. A biasing device such as a spring 20 interposed between electrical sequencing assembly 19 and cylindrical housing 11 continually urges electrical sequencing assembly 19, velocity control assembly 16, spacer 21, direction control assembly 14 and spacer 22 against bottom plate 21 to insure retention of the spacing of these components as depicted in FIG. 2. Retaining rings 23 and 24 and spacer 25 are provided on direction control shaft 15 to insure maintenance of a fixed vertical spatial relation between these components and direction control shaft 15. The shafts 15 and 17 may extend a distance beyond housing 11 at one end thereof as seen in FIG. 2 to facilitate attachment of mechanical linkages for remote control.

Figure 1:
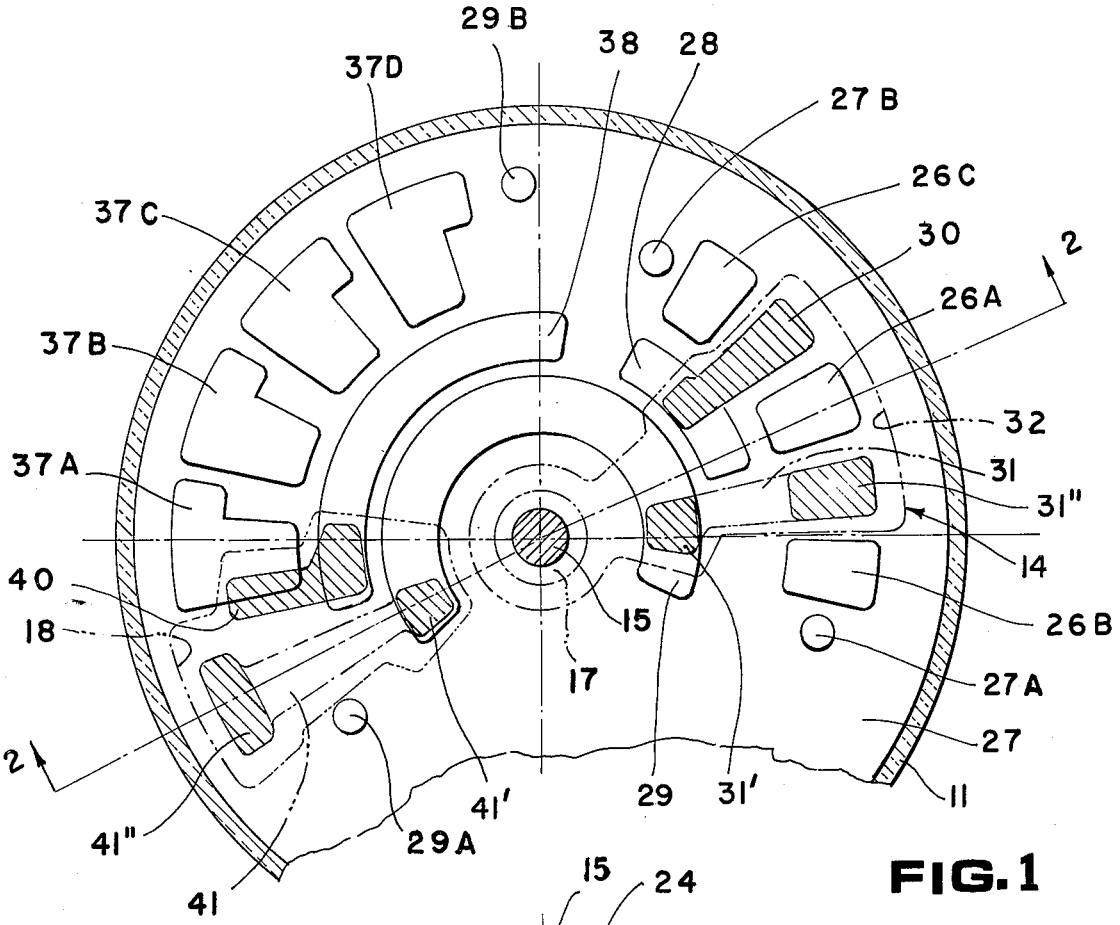
FIG. 1 is a horizontal partial sectional view of an electrical control apparatus embodying the concepts of the present invention taken substantially along the line 1—1 of FIG. 2 and depicting particularly an exemplary contact arrangement.

Turning now to FIGS. 1 and 2 a plurality of spaced direction contacts, 26A, 26B and 26C, are arranged in and flush with or extending slightly axially inwardly of an interior surface 27 of bottom plate 12. The contacts 26A, 26B, 26C may be conveniently positioned radially equidistant from the vertical axis and equiangularly spaced in an arc. Direction contacts 26A, 26B and 26C, and the other contacts hereinafter described, may be made of any suitable preferably highly conductive material such as copper, brass, silver or gold plated copper. A direction selection contact 28 is arranged in and preferably flush with or extending slightly axially inwardly of the interior surface 27 of bottom plate 12, and is radially interposed between the direction contacts 26A and 26C and a power contact 29 as in an arc defined by the maximum arcuate separation between direction contacts 26A and 26C. The power contact 29 may be arranged in surface 27 similar to contact 28 and radially interposed between the direction selection contact 28 and direction control shaft 15 in an arc extending at least between direction contacts 26A and 26B.

The directional control assembly 14 includes movable direction selection contact 30 and movable direction power contact 31 having radially inwardly and radially outwardly located contact surfaces 31' and 31'', respectively, both carried by a direction control arm 32 attached, as by a pin 33, for rotation with direction control shaft 15. Contact surfaces 30, 31', and 31'' are in a fixed spatial orientation such that when the direction control shaft 15 is rotated in a clockwise direction from the position of FIG. 1 until the movable direction power contact surfaces 31', 31'' are simultaneously in substantial contact with both the power contact 29 and the direction contact 26B, respectively, the movable direction selection contact 30 is simultaneously in substantial contact with both the direction selection contact 28 and the direction contact 26A. At this location, direction control arm 32 engages a stop 27A projecting from bottom plate 12 precluding further clockwise rotation. As will be hereinafter discussed, this positioning of the direction control assembly 14 will enable an associated motor to operate in one, such as a forward, direction of rotation. Similarly, rotating the direction control arm 32 in a counterclockwise direction until the movable direction power contact surfaces 31' and 31'' are simultaneously in substantial contact with both power contact 29 and direction contact 26A, respectively, and the movable direction selection contact surface 30 is simultaneously in substantial contact with both the direction selection contact 28 and the direction contact 26C, results in the motor operating in an opposite or perhaps reverse direction of rotation. At this location, direction control arm 32 engages a stop 27B projecting from bottom plate 12 precluding further counterclockwise rotation.

Direction contacts 26A, 26B and 26C, and all the contacts associated with bottom plate 12, have as an integral part thereof a threaded stud 39 extending through the bottom plate 12 onto which a washer 35 is positioned and a nut 36 is threadably attached for removable connection to conductors as will hereinafter be described.

Angularly displaced from direction contacts 26A, 26B and 26C, a plurality of discrete load contacts 37A, 37B, 37C, and 37D are arranged fixedly with respect to and preferably flush with or extending slightly axially inwardly of interior surface 27 of bottom plate 12 equidistant from the vertical axis and equispaced in an arc. A transition contact 38 is arranged in interior surface 27 of bottom plate 12 preferably in the manner of load contacts 37A, 37B, 37C and 37D and positioned preferably radially inwardly of the discrete load contacts 37A, 37B, 37C and 37D in an arc approximately defined by the maximum arcuate separation between discrete load contact 37A and contact 37D. The power contact 29 is positioned preferably radially inwardly of transition contact 38 and may be a circumferential extension of contact 29 associated with direction contacts 26A, 26B and 26C (as shown) or a separate element of lesser arcuate extent — substantially between contacts 37A, 37B, 37C and 37D — and electrically interconnected to that portion of power contact 29 associated with direction control assembly 14.

Movable transition contact 40 and movable velocity power contact 41 having radially inwardly and radially outwardly located contact surfaces 41' and 41'', respectively, are carried in recesses 42 in a velocity control arm 18 projecting from and, as shown, formed integrally with velocity control shaft 17. Contacts 40, 41', and 41'' are configured and in such a fixed spatial orientation that when movable velocity power contact surface 41'' is positioned substantially centrally over and engaged with a discrete load contact, such as 37A, the movable transition contact 40 is positioned substantially over and engaged with the adjacent discrete load contact, in such instance contact 37B. Angular stops 29A and 29B are positioned so as to permit velocity control arm 18 to rotate through a sufficient portion of an arc to permit movable velocity power contact surface 41'' to continuously sequentially move from an off position over interior surface 27 adjacent to discrete load contact 37A (as seen in FIG. 1) to a full velocity position centrally over and engaged with discrete load contact 37D, positions directly over discrete load contacts 37B and 37C being intermediate sequentially stepped velocity positions. Simultaneously, movable transition contact 40 continuously sequentially moves from a position partially over and engaged with discrete load contact 37A to a position over interior surface 27 adjacent to discrete load contact 37D.

Discrete load contacts 37A, 37B, 37C and 37D are shaped and spaced within an arc between angular stops 29A and 29B so as to permit movable transition contact 40 to sequentially engage first a discrete load contact, such as 37A, progressively move thereoff, and intermittently repose between discrete load contacts, such as 37A and 37B, prior to progressive engagement with the next adjacent discrete load contact, in such instances contact 37B, for electrical transition sequencing functions to be hereinafter described. Both movable velocity power contact surface 41' and movable direction power contact surface 31' continuously engage power contact 29 during the entire extent of their rotational travel. Similarly, movable transition contact 40 continuously engages transition contact 38, and in the same manner movable direction selection contact 30 continuously engages direction selection contact 28. Movable velocity power contact surfaces 41' and 41'' and movable direction power contact surface 31' and 31'' constitute axially bridged contact surfaces so as to provide nonengaging passage over transition contact 38 and direction selection contact 28, respectively, during rotation of velocity control arm 18 and direction control arm 32.

Each of the above-described movable contacts is biased axially downwardly with sufficient mechanical force to insure good electrical connection with the respective contacts of bottom plate 12. As shown by way of example, a leaf spring 43 in recess 42 urges movable velocity contact surfaces 41' and 41'' away from velocity control arm 18. Coil springs or other biasing devices could be employed equally well to effect this function.

Figure 3:
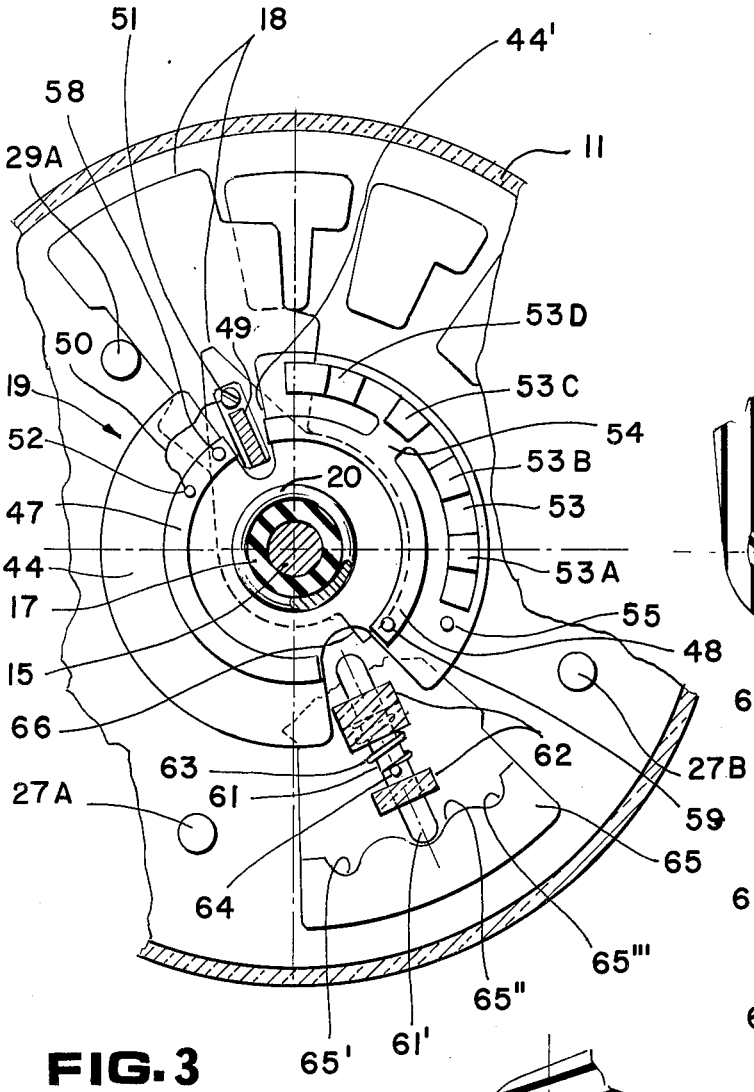
FIG. 3 is a horizontal fragmentary sectional view taken substantially along the line 3—3 of FIG. 2 showing particularly the electrical sequencing assembly and velocity control arm locking mechanism and depicting the locking mechanism in the neutral directional position allowing operation of the velocity control assembly.
Figure 7:
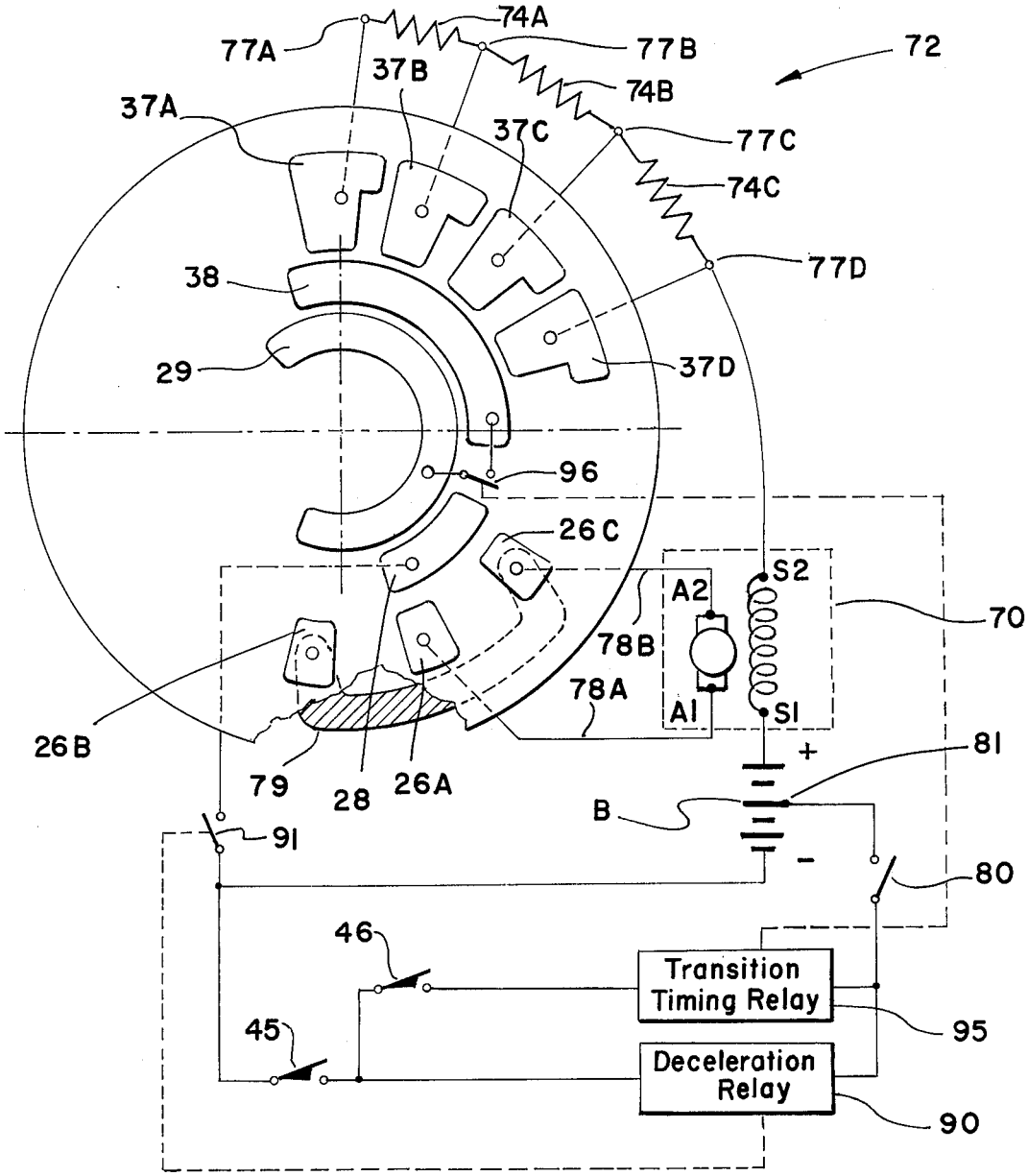
FIG. 7 is a schematic diagram of the electrical components and interconnections of the embodiment of the present invention depicted in FIGS. 1-6, above.

Referring now particularly to FIGS. 2, 3 and 7, the electrical sequencing assembly 19 includes a nonconductive disk-like member 44, a deceleration relay limit switch 45 (FIG. 7), and a transition timing relay limit switch 46 (FIG. 7). The deceleration relay limit switch 45 includes a relay power feeder bus 47 which may be partially embedded within disk-like member 44 arranged in an arcuate disposition about direction control shaft 15, and a relay power takeoff bus 48 situated on disk-like member 44 similar to relay power feeder bus 47 except preferably being disposed about a different arc on disk-like member 44 than that of relay power feeder bus 47. A vertical contact 49 extends upwardly of velocity control arm 18 through a notch 44' in disk-like member 44 to a position interposed between and proximate to the extremities of relay power feeder bus 47 and relay power takeoff bus 48. A conductor 50 is connected between vertical contact 49 and relay power feeder bus 47 by any suitable fastening devices such as screws, 51 and 52, respectively, thereby providing a single electrical identity for both vertical contact 49 and relay power feeder bus 47 and also furnishing rotational biasing to maintain vertical contact 49 in engagement with relay power takeoff bus 48 at all times during zero or forward acceleration of velocity control assembly 16 (i.e., during stationary positioning or clockwise motion of velocity control assembly 16) and disengaged with relay power takeoff bus 48 at all times during negative or deceleration of velocity control assembly 16 (i.e., during counterclockwise motion of velocity control assembly 16). As would be evident to one skilled in the art, the utilization of conductor 50 as described herein to provide a single electrical identity between two conductive materials is only one example of numerous means by which the same could be accomplished. Similarly, the utilization of conductor 50 as described herein to provide a rotational bias to maintain two conductive materials in selective engagement is also only one of numerous well-known means by which the same could be accomplished.

Transition timing relay limit switch 46 has relay power takeoff bus 48 as one of its connections and a timing cam 53 attached to disk-like member 44. Timing cam 53 has a plurality of raised contact points 53A, 53B, 53C and 53D, and a timing pin contact 55. Timing cam 53 is arranged in an arc disposed about velocity control shaft 17 and direction control shaft 15 and may be conveniently interposed between the outer circumferential edge of disk-like member 44 and power takeoff bus 48. Timing cam 53 is electrically and may be physically integrally attached to relay power takeoff bus 48 by a bridge 54.

Figure 6:
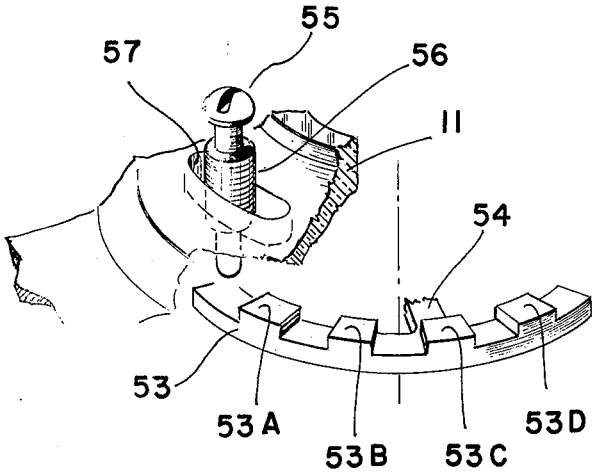
FIG. 6 is a perspective view of the cam operated timing switch as embodied within the present invention.

As may best be viewed in FIGS. 3 and 6, an interiorly threaded cylinder 56 may be adjustably affixed to an eleptical slot 57 through cylinder housing 11. Timing pin contact 55 may be threadably inserted into interiorly threaded cylinder 56 and adjusted to sequentially make contact with each of contact points 53A, 53B, 53C and 53D preferably at or shortly subsequent to the time movable transition contact 40 attains substantial surface engagement with each discrete load contact means 37A, 37B, 37C and 37D, respectively, and maintain such contact during rotation of velocity control arm 18 until just prior to the time movable transition contact 40 moves out of substantial engagement with each discrete load contact 37A, 37B, 37C and 37D, respectively, and additionally at least until movable power contact 40 moves into substantial engagement with the respective discrete load contacts. The angular adjustment of threaded cylinder 56 along eleptical slot 57 permits correction of timing anomalies due to variations or changes in mechanical tolerances.

To facilitate electrical connections, a relay power feeder bus pin contact 58 and a relay power takeoff bus pin contact 59, which may be structurally similar to timing pin contact 55, are provided in permanent pressure contact with their respective buses 47, 48 (as seen in FIGS. 2 and 3) throughout the extent of rotation of disk-like member 44. The contacts 58 and 59 also preferably engage buses 47, 48 with sufficient force to impart a degree of stability to disk-like member 44 to preclude spurious rotation due to vibration or other external forces, thereby insuring engagement of vertical contact 49 with power takeoff bus 48 only in the event of positive rotation of velocity control arm 18. Although the electrical operational aspects of both transition timing relay limit switch 46 and deceleration relay limit switch 45 will be hereinafter described, it should be herein noted that since both relay power feeder bus pin contact 58 and relay power takeoff bus pin contact 59 remain in permanent rotatable contact with their respective buses, provision for angular adjustment of the pin contacts 58 and 59 is unnecessary.

Figure 4:
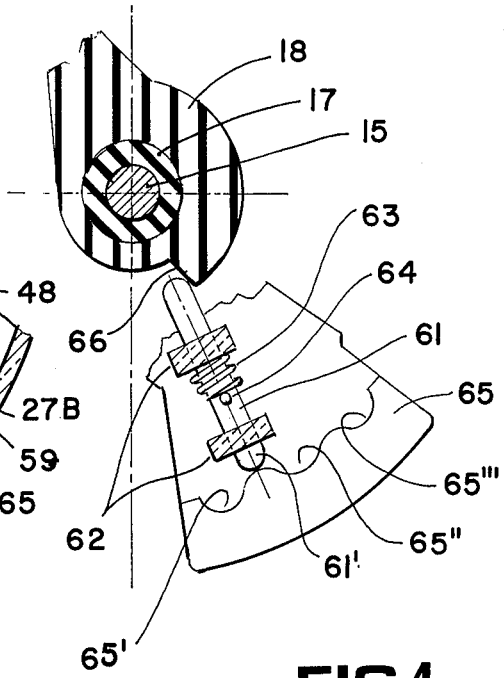
FIG. 4 is a horizontal fragmentary sectional view taken substantially along the line 4—4 of FIG. 2 showing particularly the electrical velocity control arm locking mechanism depicting the locking mechanism in an intermediate position precluding operation of the velocity control assembly.
Figure 5:
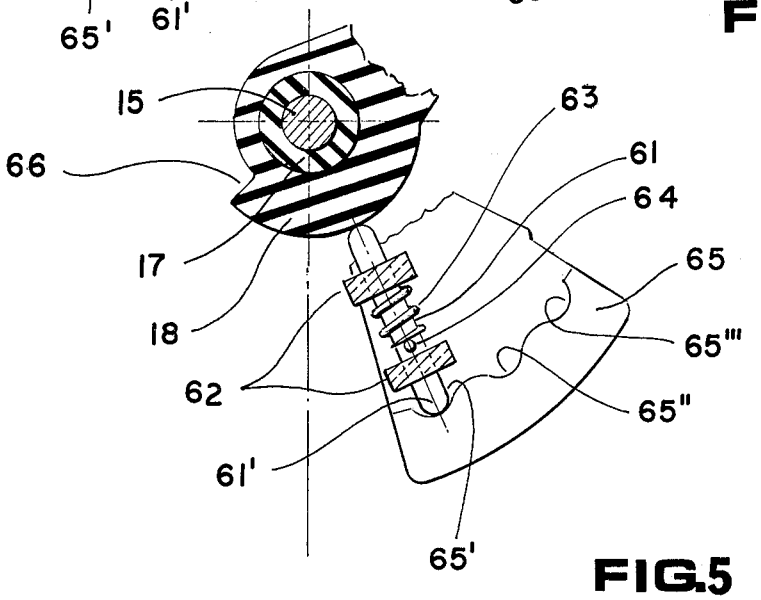
FIG. 5 is a horizontal fragmentary sectional view similar to and taken substantially as FIG. 4 of the velocity control arm locking mechanism depicting the locking mechanism in the forward directional position with the velocity control arm in an intermediate position.

Turning now to FIGS. 2, 3, 4 and 5, a velocity control arm interlocking mechanism, generally indicated by the numeral 60, operatively interrelates velocity control assembly 16 and direction control assembly 14. The interlocking mechanism 60 includes a cylindrical locking pin 61 which is slidably carried partially within a downward bifurcated extension 62 of cylindrical housing 11 and particularly arms 62' and 62'' thereof. When the direction control arm 32 is in the neutral position illustrated in FIGS. 2 and 3, a spring 63, circumposed about the locking pin 61 between one arm 62' of the bifurcated extension 62 and a spring stop pin 64, biases the radially outermost end 61' of locking pin 61 against a cam 65 which may be an integral part of direction control arm 32 so as to simultaneously rotate in conjunction therewith. The cam 65 has three angularly displaced detents, 65', 65'' and 65'''. In the neutral position, end 61' of pin 61 engages the central detent 65'' of cam 65. When the direction control shaft 15 and arm 32 are rotated in a clockwise direction from the "neutral" position of FIGS. 2 and 3, an intermediate position is reached between detents 65' and 65'', as illustrated in FIG. 4, in which cam 65 forces locking pin 61 radially inwardly into blocking engagement with a flange 66 formed on velocity control arm 18, thereby precluding operation of the velocity control assembly 16. Upon further clockwise rotation of direction control shaft 15 and arm 32, the detent 65' of cam 65 permits locking pin 61 to move sufficiently radially outward to disengage flange 66 and permit operation of the velocity control assembly 16, as seen in FIG. 5. Similarly, when rotating direction control shaft 15 and arm 32 in a counterclockwise direction from the neutral position, at any intermediate position between detents 65'' and 65''' operation of velocity control assembly 16 is precluded until locking pin 61 enters detent 65''' thereby permitting operation of velocity control assembly 16. Thus the velocity control assembly 16 may only be rotated and thereby operationally actuated from the "off" position or counterclockwise limit of rotation of velocity control arm 18 against stop 29A when the direction control arm 32 is in either the forward, neutral, or reverse position. Ancillarily it should be noted that once the velocity control arm 18 is moved from the off position with locking pin 61 in any of detents 65', 65'' and 65''', the direction control arm 32 is locked and may not be rotated until such time as the velocity control arm 17 is returned to the off position against stop 27A, thereby permitting axially inwardly displacement of the locking pin 61.

An exemplary schematic wiring arrangement for the electrical control apparatus 10 is depicted in FIG. 7 and described hereinafter in conjunction with an exemplary operating sequence. For explanatory purposes, the components of electrical control apparatus 10 are depicted in conjunction with a driven unit including a conventional direct current motor 70 having field winding terminals S1 and S2 and armature winding terminals A1 and A2. A power supply illustrated as battery unit B may be constituted of a single battery with an intermediate potential terminal, a single battery with a voltage divider network to provide an intermediate potential connection, or a bank of batteries, with an intermediate potential terminal 81, as shown, in series connection with the motor 70. An impedance device, generally indicated by the numeral 72, which may consist of a single resistance element or, as shown, of a plurality of resistance elements 74A, 74B and 74C having connections 77A, 77B, 77C and 77D is connected to a field winding terminal, such as S2, of motor 70 on the side opposite battery unit B, thereby providing a selective resistance component from a maximum at terminal 77A to a least resistance component a terminal 77D. Terminals 77A, 77B, 77C and 77D are connected to studs 39 of load contact 37A, 37B, 37C and 37D, respectively, of electrical control apparatus 10, as illustrated.

Armature winding terminals A1 and A2 of motor 70 are connected to direction contacts 26A and 26C, respectively, such as by wires 78A and 78B. Direction contact 26C is connected to direction contact 26B by jumper 79 which, as illustrated, may be a conductor such as copper wire connected to threaded studs 39 corresponding to direction contacts 26A and 26C by nuts 36.

A conventional "on-off" switch 80 is connected in series between intermediate potential terminal 81 of battery unit B and a deceleration relay 90 and a transition timing relay 95 in order to permit operation of relays 90 and 95. "On-off" switch 80 need only have sufficient current carrying and interrupting capacity to feed the relatively small current relays thus obviating the necessity for a high ampere ignition switch as is frequently required in similar applications. Deceleration relay 90 which may be a conventional electromagnetic relay with a contact switch 91 normally open when the relay is de-energized and mechanically interlocked to close when the relay is energized, has its end opposite to that connected with "on-off" switch 80 connected to both the deceleration relay limit switch 45 and the transition timing relay limit switch 46 at relay power takeoff bus pin contact 59 (see FIG. 3). Transition timing relay 95, which similar to deceleration relay 90, may be a conventional electromagnetic relay with contact switch 96, has its end opposite to that connected with "on-off" switch 80 connected to the end of transition timing relay limit switch 46 opposite that connected to deceleration relay 90, connected at timing pin contact 55. The end of deceleration relay limit switch 45 opposite that connected to deceleration relay 90 at relay power feeder bus pin contact 58 is connected to the terminal of battery unit B opposite that connected to motor 70.

Deceleration relay contact switch 91 is connected between the terminal of battery unit B opposite that connected to motor 70 and direction selection contact 28 so as to permit, when closed by deceleration relay 90, energy transfer through electrical control apparatus 10 at direction selection contact 28. Transition timing relay contact switch 96 is connected between power contact 29 and transition contact 28 so as to permit, when closed by deceleration relay 90, certain electrical transition functions to be set out hereinafter.

Referring particularly to FIGS. 1, 2, 3, and especially FIG. 7, a typical operating sequence employing the electrical control apparatus 10 in the arrangement depicted could proceed as hereinafter set forth. Beginning with the velocity control assembly 16 in the off position and the direction control assembly 14 in the neutral position, the "on-off" switch 80 would be closed so as to permit operation of relays 90 and 95. Next, direction control assembly 14 may be rotated into the desired directional position, such as forward, by the appropriate rotation of direction control shaft 15 as previously described. With the direction control assembly 14 in the forward position as previously described, a motor circuit is completed in which an armature current of motor 70 could travel through power contact 29, movable direction power contact 31 engaged therewith, direction contact 26B, jumper 79, direction contact 26C, and wire 78B to armature winding terminal A2, whereupon the armature current after passing through the armature winding of motor 70 may complete the circuit through further portions of the electrical control apparatus 10, as will be hereinafter described, by passing through wire 78A, direction contact 26A, and movable direction selection contact 30 to direction selection contact 28. When the direction control assembly 14 is in the reverse position as previously described, the polarity of armature current through motor 70 is reversed effectuating a reverse directional change in any device driven thereby.

Also upon positioning the direction control assembly 14 in the forward position, the velocity control arm locking mechanism 60 allows operation of velocity control assembly 16. Thus, clockwise rotation of velocity control assembly 16 by a similar rotation of velocity control shaft 17 as hereinbefore described may be initiated.

In order to operate electrical control apparatus 10 with large power requirements frequently associated with such devices as motor 70, electrical transition circuitry is provided for purposes of eliminating or at least minimizing arcing which might accompany velocity control assembly 16 in sequentially contacting discrete load contacts 37. In general, the transition circuitry provides a substantially maintainable full load alternate current path through each of the discrete load contacts 37 prior to engagement of the same by movable velocity power contact 41 which also thereby substantially equalizes the potential of discrete load contacts 37 and movable velocity power contact 41 at the time of engagement.

As seen in FIGS. 1, 3, 6, and 7 and previously described, any clockwise rotation or slight clockwise rotational biasing of velocity control assembly 16 closes deceleration relay limit switch 45, energizing deceleration relay 90, thereby closing deceleration relay contact switch 91 and connecting direction selection contact 28 to battery unit B as previously noted, and shall hereinafter be referred to as the zero or positive acceleration state. Further incremental clockwise rotation of velocity control assembly 16 results in the closing of transition timing relay limit switch 46 also as described above, energizing transition timing relay 95, thereby closing transition timing relay contact switch 96, and completing an alternate current path allowing a current to flow substantially as follows: from battery unit B, through deceleration relay contact 91; through direction selection contact 28 and the armature winding of motor 70 to power contact 29 as detailed above; through power contact 29, transition timing relay contact 96, transition contact 38, movable transition contact 40, discrete load contact 37A, a maximum resistance component 74A, 74B and 74C, and through the field winding of motor 70 back to the opposite terminal of battery unit B from whence the path began.

It is thus clear that since movable transition contact 40 is centrally over and engaged with discrete load contact 37A prior to the establishment of a current flow therethrough, arcing is eliminated or substantially reduced between these aforesaid contacts. Arcing or any tendency to arc resulting from a change in the transition state is further eliminated or reduced by utilization of maximum resistance component 74A, 74B and 74C to graduate the initial current flow to a minimal magnitude. It should also be noted that nearly any further remaining residual arcing is essentially localized within transition timing relay contact switch 96, a readily accessible, easily maintainable, and relatively inexpensive contact portion of transition timing relay 95, thereby greatly extending the operable lifetime of electrical control apparatus 10 while simultaneously reducing the maintenance frequency, cost, and downtime for any such device requiring large quantities of power such as motor 70.

Another further incremental clockwise rotation of velocity control assembly 16 has as its consequence an engagement between movable velocity power contact 41 and discrete load contact 37A during which time movable transition contact 40 remains in substantial engagement with discrete load contact 37A in the transition state just discussed. Once again it is clear that since an existing relatively low impedance alternate current path is first established between power contact 29 and discrete load contact 27A via transition timing relay contact switch 96, transition contact 38, and movable transition contact 40, movable velocity power contact 41 is at substantially the same potential as discrete load contact 37A prior to its engagement therewith and second, little if any current will flow through the initially relatively high impedance path between power contact 29 and discrete load contact 37A via movable velocity power contact 41, again eliminating or substantially reducing any arcing or any tendency theretoward.

As movable transition contact 40 is further continuously enaging discrete load contact 37A, the initially relatively high impedance value of movable transition contact 40 is continuously proportionally reduced, while simultaneously the initially relatively low impedance value of movable transition contact 40, continuously disengaging discrete load contact 37A, is continuously proportionally increased.

Thus, a continuously changing current division occurs between movable velocity power contact 41, whose proportion of the current is increasing in magnitude and movable transition contact 40, whose proportion of the current is decreasing in magnitude, until immediately prior to the substantial disengagement of movable transition contact 40 with discrete load contact 37A, the current through movable transition contact 40 is substantially reduced. At this point in the sequence transition timing relay limit switch 46 opens, de-energizing transition timing relay 95 and thereby opening transition timing relay contact switch 96 effectuating an electrical severing of the power contact 29 with discrete load contact 37A through transition contact 38 and movable transition contact 40 and ending the transition state, again substantially without arcing.

Electrical switch apparatus 10 remains in this state until, upon further incremental clockwise rotation of velocity control assembly 16, movable transition contact comes into substantial engagement with the adjacent discrete load contact 37B. Once again a transition similar to that described above, is established. In this particular state, since the current flow through movable transition contact 40 need only pass through the lower resistance component 74B and 74C, initially a discretely proportionally higher current flows through the full load alternate current path transitioning circuit than that which flows through movable velocity power contact 41, thereby establishing movable velocity power contact 41 at substantially the same potential as discrete load contact 37B prior to its engagement therewith which again eliminates or substantially reduces arcing between movable velocity power contact 41 and discrete load contact 37B, whereupon further incremental clockwise rotation concludes the transition state and provides for passage of full load current solely through movable velocity power contact 41. This operating sequence is twice additionally repeated until the resistance component through which the current flows is at a minimum and full load current is permitted to flow, the intermediate steps providing a graduated change in the magnitude of electrical energy transfer to the motor 70.

It has been found that in certain applications wherein power to the external load is unnecessary and/or undesirable during certain phases of operation, such as deceleration, a cutoff device may be provided so as to entirely disconnect and isolate the electrical control apparatus 10 from either or both of the external power source or the external load. In the present invention one such device has been provided, deceleration relay 90, with contact switch 91 interposed between power source battery unit B and the electrical control apparatus 10 at direction selection contact 28. As discussed previously, any deceleration effectuated by counterclockwise rotation of velocity control assembly 16 results in the opening of deceleration relay contact switch 91 and disconnection and isolation of the electrical control apparatus 10 from the external power source battery unit B. Deceleration may, if desired, be completed in an intermediate velocity position whereupon deceleration relay 90 will re-establish current flow through the electrical control apparatus 10 as discussed hereinabove. It is to be noted that any arcing resulting from interruption of any degree of established current flow through any portion of electrical control apparatus 10 will be localized within deceleration relay contact switch 91, a readily accessible, easily maintainable, and relatively inexpensive contact portion of deceleration relay 90, thereby greatly extending the operable lifetime of electrical control apparatus 10 while simultaneously reducing the maintenance frequency, cost, and downtime for any such device requiring large quantities of power such as motor 70.

Inasmuch as the present invention is subject to many variations, modifications, and changes in detail, a number of which have been expressly stated herein, it is intended that all matter described above or shown in the accompanying drawings be interpreted as illustrative and not in a limiting sense.

We claim:

1. An electrical control apparatus comprising, mounting means, a plurality of discrete load contact means disposed in fixed relation on said mounting means and connected with differing magnitudes of impedance, power contact means movable relative to said discrete load contact means for permitting continuously progressive, sequential engagement therewith, transition contact means connected to each of said discrete load contact means prior to engagement by said power contact means, and transition circuit means providing a maintainable full load alternate current path through said transition contact means and each of said plurality of discrete load contact means prior to engagement of said discrete load contact means by said power contact means, thereby providing a graduated change in the magnitude of electrical energy transfer substantially without arcing between said contact means.

2. Apparatus according to claim 1, wherein said transition contact means are movable relative to and engage said discrete load contact means.

3. Apparatus according to claim 2, wherein said transition contact means and said power contact means are maintained in fixed spatial relation.

4. Apparatus according to claim 3, wherein said transition contact means and said power contact means are carried by control arm means.

5. Apparatus according to claim 4, wherein said control arm means is mounted for rotation relative to said discrete contact means about shaft means.

6. Apparatus according to claim 5 wherein said load contact means are arcuately disposed about said shaft means and stop means associated with said mounting means limit the extent of rotational travel of said control arm means to substantially the arcuate disposition of said load contact means.

7. Apparatus according to claim 1, wherein said transition circuit means includes switch means maintainably intermittently establishing current flow through said transition contact means.

8. Apparatus according to claim 7, wherein said switch means operates to establish current flow through any of said load contact means only upon said transition contact means being brought into substantial engagement therewith and operates to sever the current flow through said transition contact means prior to disengaging any of said load contact means.

9. Apparatus according to claim 8 wherein said switch means includes timing cam means and timing contact means making and breaking contact in correlation with sequential engagement of said load contact means by said transition contact means.

10. Apparatus according to claim 1 wherein said transition contact means engage said load contact means to establish the full load alternate current path.

11. Apparatus according to claim 1 including cutoff means effecting disconnection of the electrical energy transfer upon relative motion between said load contact means and said power contact means in one direction.

12. Apparatus according to claim 11 wherein said cutoff means establishes the electrical energy transfer upon relative motion between said load contact means and said power contact means in the other direction and in the absence of relative motion therebetween.

13. Apparatus according to claim 1, wherein said transition circuit means includes separate contact means wherein any arcing is localized.

14. An electrical control apparatus comprising, mounting means, a plurality of contact means disposed in fixed relation on said mounting means, first movable contact means continuously progressively, engaging certain of said plurality of contact means, second movable contact means associated with said first movable contact means first engaging each of said contact means engaged by said first movable contact means to provide a substantially maintainable alternate full load current path through each of said contact means engaged by said first movable contact means prior to engagement by said first movable contact means, thereby providing a transition between said contact means engaged by said first movable contact means which are connected to differing magnitudes of impedance substantially without arcing, and third movable contact means selectively engaging other of said plurality of contact means for effecting a switching function with respect thereto.

15. Apparatus according to claim 14, wherein said third movable contact means moves independently of said first movable contact means.

16. Apparatus according to claim 15, wherein said second movable contact means and said first movable contact means are maintained in fixed spatial relation.

17. Apparatus according to claim 14, wherein said first movable contact means is carried by a velocity control arm and said third movable contact means is carried by a direction control arm.

18. Apparatus according to claim 16, including interlocking means between said velocity control arm and said direction control arm.

19. Apparatus according to claim 17, wherein said interlocking means includes a biased locking pin operatively engaging a cam.

20. An electrical control apparatus comprising, mounting means, a plurality of discrete load contact means disposed in fixed relation on said mounting means and connected with differing magnitudes of impedance, power contact means movable relative to said load contact means for permitting continuously progressive, sequential engagement therewith, transition contact means connected to each of said plurality of discrete load contact means prior to engagement by said power contact means and providing a maintainable full load alternate current path through each of said plurality of discrete load contact means prior to engagement of same by said power contact means upon relative motion between said discrete load contact means and said power contact means in one direction, and cutoff means effecting a disconnection of the electrical energy transfer upon relative motion in the opposite direction.

21. Apparatus according to claim 20, wherein said cutoff means permits electrical energy transfer in the absence of relative motion between said discrete load contact means and said power contact means.

22. Apparatus according to claim 21, wherein said cutoff means includes bus means on a disk means rotatably mounted about shaft means and contact means movable with said power contact means about said shaft means for engaging said bus means upon relative rotation in the one direction.

23. Apparatus according to claim 22, including biasing means maintaining said contact means in engagement with said bus means during relative rotation in the one direction or the absence of relative rotation.

24. Apparatus according to claim 23, including pin contact means engaging said bus means for purposes of rotationally stabilizing said disk means.

25. Apparatus according to claim 24 wherein said pin contact means provides maintainable electrical contact with said bus means.

26. An electrical control apparatus comprising, mounting means, a plurality of discrete load contact means disposed in fixed relation on said mounting means and connected with differing magnitudes of impedance, power contact means movable relative to said load contact means for permitting continuously progressive, sequential engagement therewith, transition contact means connected to each of said plurality of discrete load contact means prior to engagement by said power contact means, transition circuit means providing a maintainable full load alternate current path through said transition contact means and each of said plurality of discrete load contact means prior to engagement of said discrete load contact means by said power contact means upon relative motion between said discrete load contact means and said power contact means in one direction, and cutoff means effecting a disconnection of the electrical energy transfer upon relative motion in the opposite direction.

27. Apparatus according to claim 22 wherein said transition circuit means is attached to said cutoff means for permitting a control current to flow therebetween.

28. Apparatus according to claim 13, wherein said separate contact means includes first separate contact means and second separate contact means both located externally to said mounting means.

29. Apparatus according to claim 28, wherein said first separate contact means includes a contact portion of an electromagnetic relay having a finite cycling time for localizing any arcing resulting from a change in transition state.

30. Apparatus according to claim 29, wherein said second separate contact means includes a contact portion of an electromagnetic relay having a finite cycling time for localizing any arcing resulting from interruption of any degree of established current flow through any portion of said apparatus.

31. Apparatus according to claim 30, further comprising means for insuring that sequential engagement of any of said contact means with said discrete load contact means occurs at a rate compatible with the cycling times of said electromagnetic relays.

32. An electrical control apparatus comprising, mounting means, a plurality of discrete load contact means disposed in fixed relation on said mounting means and connected with differing magnitudes of impedance, power contact means movable relative to said discrete load contact means for sequential engagement therewith, transition contact means connected to each of said discrete load contact means prior to engagement by said power contact means, and transition circuit means providing a full load alternate current path through said transition contact means and each of said plurality of discrete load contact means prior to engagement of said discrete load contact means by said power contact means, said power contact means including contact surface means for permitting a continuous, progressively sequential bridging of adjacent said discrete load contact means and permitting a continuously changing current division between said power contact means and said transition contact means, thereby providing a graduated change in the magnitude of electrical energy transfer substantially without arcing between said discrete load contact means and said power contact means.

33. Apparatus according to claim 32, wherein said transition contact means are movable relative to and engage said discrete load contact means.

34. Apparatus according to claim 33, wherein said transition contact means and said power contact means are maintained in fixed spatial relation.

35. An electrical control apparatus comprising, mounting means, a plurality of discrete load contact means disposed in fixed relation on said mounting means and connected with differing magnitudes of impedance, power contact means movable relative to said discrete load contact means for permitting continuously progressive, sequential engagement therewith, transition contact means connected to each of said discrete load contact means prior to engagement by said power contact means, and transition circuit means providing a full load alternate current path through said transition contact means and each of said plurality of discrete load contact means prior to engagement of said discrete load contact means by said power contact means and maintaining said alternate current path at least until said power contact means engages said discrete load contact means, thereby providing a graduated change in the magnitude of electrical energy transfer substantially without arcing between said contact means.

36. Apparatus according to claim 35, wherein said transition contact means are movable relative to, progressively engage and disengage, and intermittently repose between said discrete load contact means.

37. Apparatus according to claim 36, wherein said transition contact means and said power contact means are maintained in fixed spatial relation.

38. An electrical control apparatus comprising, mounting means, a plurality of discrete load contact means disposed in fixed relation on said mounting means and connected with differing magnitudes of impedance, power contact means movable relative to said discrete load contact means for permitting continuously progressive, sequential engagement therewith, transition contact means connected to each of said discrete load contact means prior to engagement by said power contact means, and transition circuit means equalizing the potential on both said transition contact means and said power contact means prior to and during engagement of the latter with the next adjacent said discrete load contact, thereby providing a graduated change in the magnitude of electrical energy transfer substantially without arcing between said contact means.

39. Apparatus according to claim 38, wherein said transition contact means are movable relative to, progressively engage and disengage, and intermittently repose between said discrete load contact means.

40. Apparatus according to claim 39, wherein said transition contact means and said power contact means are maintained in fixed spatial relation.

* * * * *

UNITED STATES PATENT OFFICE
CERTIFICATE OF CORRECTION

PATENT NO. : 4,112,274

DATED : September 5, 1978

INVENTOR(S) : Chester Joseph Pigman & James Arthur Pewton, Sr.

It is certified that error appears in the above-identified patent and that said Letters Patent are hereby corrected as shown below:

Column 3, line 38, delete the second occurrence of the word "the".

Column 4, line 6, "through" should read --throughout-- line 49, "21" should read --12--.

Column 7, lines 51 and 66, the word "eleptical" should read --elliptical--.

Column 11, line 40, "27A" should read --37A--.

In Fig. 2, the lead line from the numeral 25 should go to the spacer shown in cross section immediately beneath bottom plate 12 and centered about the vertical axis of apparatus 10; the lead line from the numeral 23 should go to the retainer ring shown in cross section immediately beneath spacer 25 and centered about the vertical axis of apparatus 10.

Claim 18, line 1, "16" should read --17--.

Signed and Sealed this

*Seventeenth* Day of *July 1979*

[SEAL]

*Attest:*

*Attesting Officer*

LUTRELLE F. PARKER

*Acting Commissioner of Patents and Trademarks*